US007600551B2

(12) United States Patent
Lussier

(10) Patent No.: US 7,600,551 B2
(45) Date of Patent: Oct. 13, 2009

(54) MECHANISM FOR THE OPERATION OF MULTIPLE PANELS DOOR WITH INCREASED INSULATING PROPERTIES

(76) Inventor: Jacques Lussier, 145, Robert, St-Raymond, Quebec (CA) G3L 4S2

( * ) Notice: Subject to any disclaimer, the term of this patent is extended or adjusted under 35 U.S.C. 154(b) by 42 days.

(21) Appl. No.: 11/651,740

(22) Filed: Jan. 9, 2007

(65) Prior Publication Data

US 2008/0163552 A1 Jul. 10, 2008

Related U.S. Application Data

(60) Provisional application No. 60/757,321, filed on Jan. 9, 2006.

(51) Int. Cl.
*E05D 15/20* (2006.01)

(52) U.S. Cl. ..... 160/209; 160/40

(58) Field of Classification Search ..... 160/209, 160/40, 201; 49/197, 199, 203, 204, 205
See application file for complete search history.

(56) References Cited

U.S. PATENT DOCUMENTS 2,029,201 A * 1/1936 Shaffer ..... 160/190
2,059,585 A * 11/1936 Kelly ..... 160/209
2,189,019 A * 2/1940 Rowe ..... 160/209
2,217,437 A * 10/1940 Ferris et al. ..... 160/209
2,294,361 A * 9/1942 Blodgett ..... 160/209
2,323,807 A * 7/1943 Birdie et al. ..... 160/191
2,329,443 A * 9/1943 Rowe ..... 160/209
2,655,683 A * 10/1953 Mckee et al. ..... 16/104
2,855,989 A * 10/1958 Pritchard ..... 160/40
3,027,937 A * 4/1962 Wilson ..... 160/40
3,034,575 A * 5/1962 Stroup ..... 160/40
3,856,073 A * 12/1974 Risser ..... 160/201
5,277,240 A * 1/1994 Epema et al. ..... 160/188
5,799,368 A * 9/1998 Young ..... 16/92
5,909,762 A * 6/1999 Denoual et al. ..... 160/201
6,094,779 A * 8/2000 Young ..... 16/92
6,928,696 B2 8/2005 Wartman

* cited by examiner

*Primary Examiner*—David Purol

(57) ABSTRACT

An improved mechanism for the operation of multiple panels door with increased insulating properties comprises a means that keeps the door panels away from the seal as they move up or down vertically and that brings the panels tightly against the seal when the panels have completed their vertical course. In the prior art, a multiple panel door follows the path of the guide rail where in this instant invention, when the panels have run their course along the path of the guide rails, they are moved away from the guide rails and against the door frame, which results in the door panels to apply pressure against an insulating strip.

1 Claim, 3 Drawing Sheets

FIG. 2b
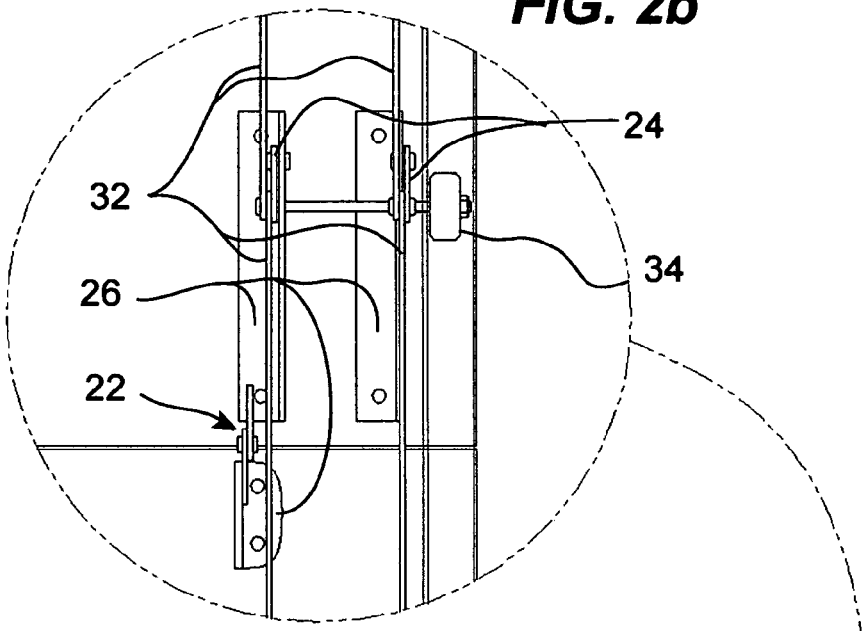
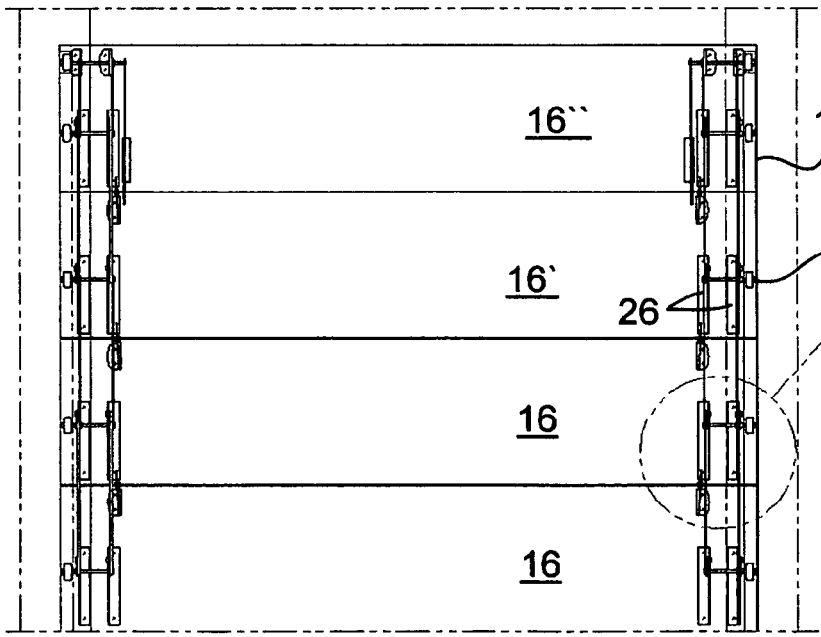
FIG. 2a

MECHANISM FOR THE OPERATION OF MULTIPLE PANELS DOOR WITH INCREASED INSULATING PROPERTIES

This application claims priority based on provisional application 60/757,321 filed Jan. 9, 2006

FIELD OF THE INVENTION

The invention relates generally to doors having multiple panels such as, for example, garage doors but more specifically to a mechanism which provides for better insulating properties.

BACKGROUND OF THE INVENTION

Vertically opening doors having multiple panels are mostly known for their use as car garage doors although they can be used for other applications. Over the years steel, aluminum or vinyl covered doors with an insulating core have been developed to increase insulating properties. No matter the insulating properties of the core, there remains heat loss due to the poor sealing characteristics of the perimeter seal which allows air to circulate. The problem is not so much that the seal is poor, it is because the constant friction of the door opening and closing against the seal makes it less efficient, plus the fact that, to begin with, in order not to cause to much of a hindrance to the operation of the door, the seal cannot create too much friction against the door so that it can open or close relatively effort free so as not to over work the motor doing the opening and closing operation or a user manually opening or closing the door. None of the prior art adequately addresses these issues and therefore there is room for improvement in the sealing characteristics of such doors.

SUMMARY OF THE INVENTION

In view of the foregoing disadvantages inherent in the known devices now present in the prior art, the present invention, which will be described subsequently in greater detail, is to provide objects and advantages which are:

To provide for an improved mechanism for the operation of multiple panels door which improves insulating properties.

To provide for an improved mechanism for the operation of multiple panels door which does not create undue resistance on the door movement so as to require a more powerful motor or require unnecessary strain on the part of a user manually operating the door.

To attain these ends, the invention comprises a means that keeps the door panels away from the seal as they move up or down vertically and that brings the panels tightly against the seal when the panels have completed their vertical course.

The invention comprises a pair of hinge mechanism for each of the door panel and the hinge mechanism is further comprised of a clamshell module and a cam.

The clamshell module having a first part on one of the panel and a second part on another panel. Each of the cam is associated with one of the clamshell module by way of a plate fixedly attached to any one of the panels. The plate is located proximal to the clamshell module and the cam is rotationally attached to the plate at its proximal end and rotationally attached to a blade at its distal end. Each of the blade is connected to a caster and each of the caster rolls within the guide rail.

A top cam, rotationally attached to the plate on its proximal end and the plate fixedly attached on one of the panels and the top cam is rotationally attached to a secondary cam on its distal end. The top cam is situated between a top caster and a top plate.

A <<Y>> configuration between the secondary cam, the cam and the top blade is able to change into a <<T>> configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 2*a-b* Front view of the mechanism with detail front view, respectively.

DETAILED DESCRIPTION

Figure 1A:
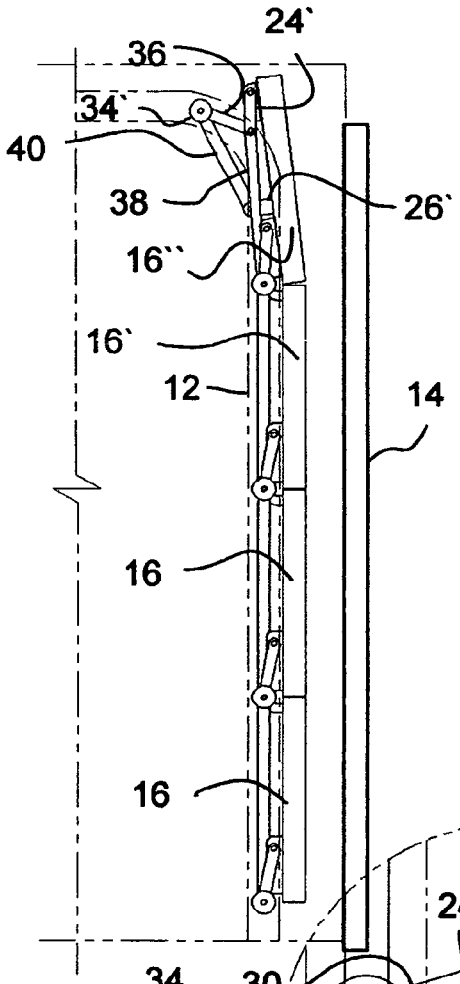
FIGS. 1*a-b-c* Side views of the mechanism with the door partially open and the door closed, with a detail side view of the hinge mechanism, respectively.

A mechanism for the operation of multiple panels door (10) works in conjunction with a pair of guide rails (12) (only one shown in dotted lines in FIG. 1*ab*) as are commonly used in the art. The guide rails (12) do not require any special modifications except that they are set back from a door frame (14) in a distance greater than is usually used in the art. It is also recommended that the guide rails (12) have additional bracing (not shown) so that they can sustain more stress than normal in the art.

The door panels (16) are also well known in the art and standard off the shelf panels (16) can be used in conjunction with standard oil the shelf guide rails (12), where the invention mostly lies is in hinge mechanism (18) which is substantially different from hinges of the prior art (not shown).

When the panels (16) have run their course along the path of the guide rails (12), they are moved away from the guide rails (12) to be put against the door frame (14), which results in the door panels (16) applying pressure against an insulating strip (20). This insulating strip (20) can be derived from existing types known in the art or it can be specially created or adapted for this application since, by moving towards the insulating strip (20), the door (10) applies pressure onto the strip (20) which can thus be thicker and resiliently deformable which can provide for a better seal. A variety of elastomers could be used to perform that function. It is not, however, within the scope of this invention to give more details on the exact composition or properties of such a sealing strip.

The hinge mechanism (18) is comprised of a clamshell module (22) and a cam (24). For each two panels (16), there is a pair of such hinge mechanism (18) that is shared since the clamshell module (22) requires to have a first part (22') on one panel (16) and a second part (22") on another panel (16'), this is obvious for anyone familiar with the workings of any hinge.

Each cam (24) is rotationally attached to a plate (26) and the plate (26) has a clamshell module (22) fixedly attached to it plate (26) fixedly attached to a panel (16) proximal the clamshell module (22). The cam (24) is rotationally attached to the plate (26) at its proximal end (28) and rotationally attached to a blade (32) at its distal end (30). Each blade (32) is connected to a caster (34) and each caster (34) rolls within the guide rail (12) as is known for any prior art multiple panel door except that in this case, the blades (32) act as it they were door panels (16).

As the panels (16) move upwardly or downwardly, the cams (24) are in a substantially parallel relation with the guide rails (12) as per FIG. 1*a*. When a first caster (34') reaches the end of the guide rail (12'), all panels (16) are now parallel with the guide rails (12). A top cam (24') has the unique feature of being, on its proximal end (28), rotationally attached to a top plate (27) on a top panel (16") wherein another plate (26) is also fixedly attached and, on its distal end (30), being rotationally attached to a secondary cam (36).

This arrangement induces all cams (24) to move from a substantially parallel position in relation to the guide rails (12), to a substantially perpendicular relation to the guide rails (12). As can be seen in FIG. 1*a*, there is at <<Y>> configuration between the secondary cam (36), the cam (24') and a top blade (38) whereas in FIG. 1*b* there is <<T>> configuration between these same elements.

Figure 1B:
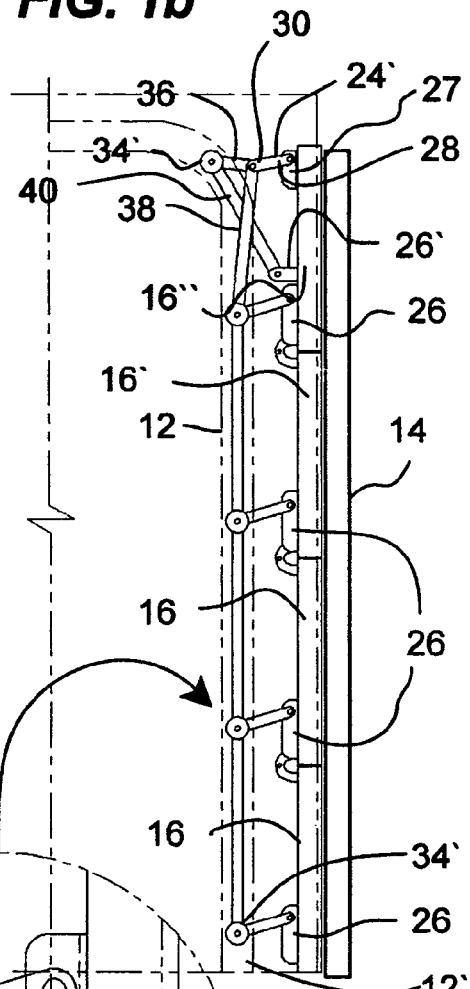
Figure 1C:
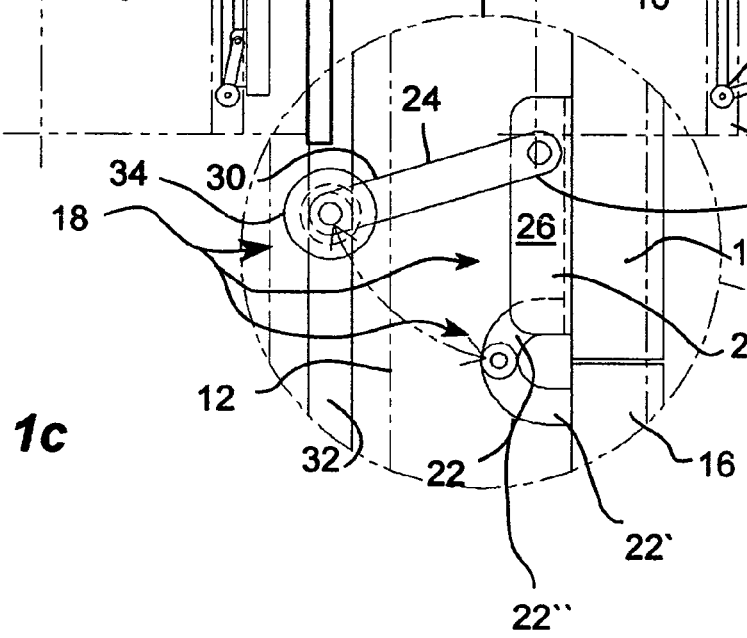
Figure 3A:
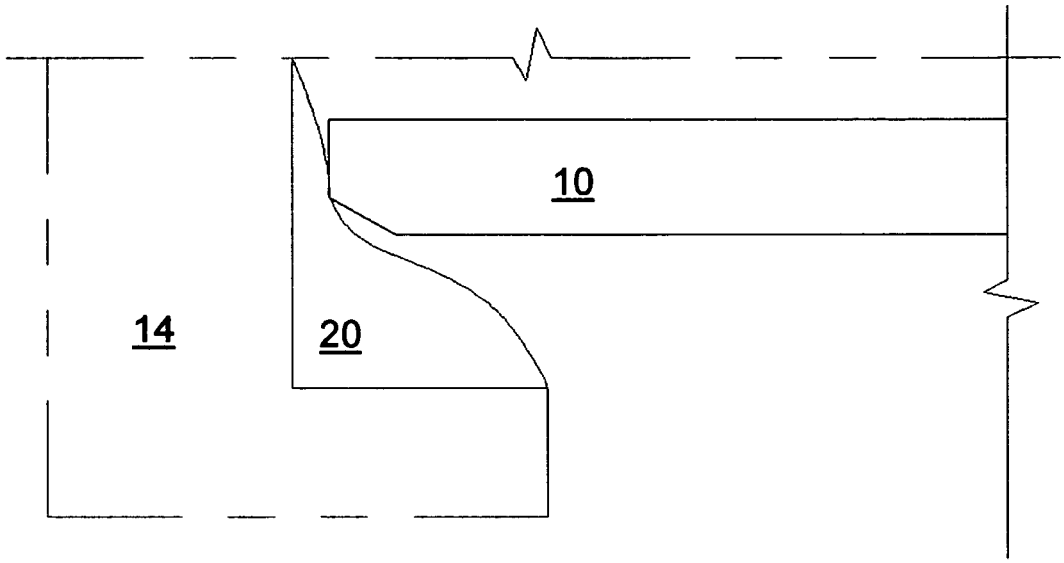
FIGS. 3*a-b* Top views of the door interacting with the seal, open and closed, respectively.
Figure 3B:
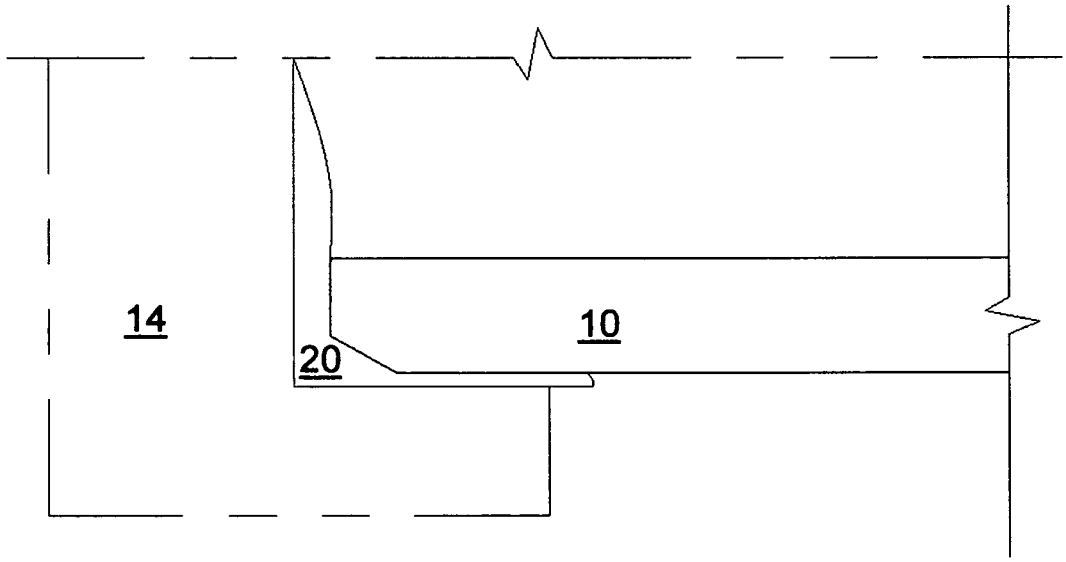

The arctuate shape of the guide rails (12) forces this change in configuration between what is seen in FIG. 1*a* and FIG. 1*b* as a top panel (16") passes from a horizontal position into a vertical position. The top blade (38') being substantially longer than the cams (24) makes the top panel (16") move faster which has the effect of changing that configuration and lift all other cams (24), which moves the door (10) away from the frame (14) when the door (10) is opening, and moving the door (10) against the frame (14) when it is closing.

Also, a cam (40) situated between a top caster (34') and an attachment bracket (26') contributes to the changing in the configuration by maintaining a relative distance between the top plate (26') and the top caster (34') so as to force the change between the configuration of FIG. 1*a* and the that of FIG. 1*b*.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A mechanism for the operation of multiple panels door working in conjunction with a pair of guide rails and panels further comprising:

a pair of hinge mechanism for each of a plurality of garage door panels;

said pair of hinge mechanism consisting of a clamshell module and a cam;

said clamshell module having a first part on one said plurality of garage door panels and a second part on another one of said plurality of garage door panels;

each said cam being rotationally attached to a plate and the plate having a clamshell module fixedly attached to the plate;

the plate being fixedly attached to one of a plurality of said garage door panels;

said cam being rotationally attached to said plate at said cam proximal end and rotationally attached to a blade at said cam distal end;

each said blade being connected to a caster and each said caster rolling within one of said pair of guide rails;

a top cam rotationally attached to a top plate on said top cam proximal end and said top plate being fixedly attached to a top panel said top panel being the uppermost of said plurality of garage door panels and;

said top cam being rotationally attached to a secondary cam on said top cam distal end;

said top cam situated between a top caster and said top plate;

a first caster rotationally attached to a secondary cam and a long cam;

a top cam having a distal end rotationally attached to a top plate and a proximal end rotationally attached to a top blade;

a top blade having a proximal end rotationally attached to a secondary cam and said proximal end of said top cam;

said top blade having said top blade distal end rotationally attached to a caster;

said long cam having said long cam proximal end rotationally attached to said first caster and said secondary cam;

said long cam having said long cam distal end rotationally attached to an attachment bracket;

one top caster on each rail of said pair of rails;

said first caster traveling from an horizontal part of said rail onto a vertical part of said rail as said multiple panels door closes;

distance between said first caster and said distal end of said top blade being reduced so that said secondary cam and said top cam change their relative positions from a "Y" configuration into a "T" configuration;

said "T" configuration inducing said cams from being substantially parallel to said rail to being substantially perpendicular to said rail.

* * * * *